United States Patent [19]

Griffin et al.

[11] Patent Number: 4,576,762

[45] Date of Patent: Mar. 18, 1986

[54] THROTTLE RETURN SPRING ASSEMBLY

[75] Inventors: Michael D. Griffin; Ronald A. Waydelis, both of Rochester, N.Y.

[73] Assignee: General Motors Corporation, Detroit, Mich.

[21] Appl. No.: 710,399

[22] Filed: Mar. 11, 1985

[51] Int. Cl.[4] ..... F02M 19/12

[52] U.S. Cl. ..... 261/65; 123/198 D; 74/513; 267/57.1 A; 267/58; 267/155; 267/168

[58] Field of Search ..... 123/198 D; 261/65; 74/513; 267/57.1 A, 58, 154, 155, 168

[56] References Cited

U.S. PATENT DOCUMENTS

| | | | |
|---|---|---|---|
| 2,248,447 | 7/1941 | Wood | 267/168 |
| 2,298,337 | 10/1942 | Thompson | 267/168 |
| 3,147,964 | 9/1964 | Wolf | 267/57.1 A |
| 3,880,414 | 4/1975 | Smith et al. | 267/168 |
| 3,927,657 | 12/1975 | Mennesson | 123/198 D |
| 3,943,907 | 3/1976 | Kluth | 123/198 D |
| 4,476,068 | 10/1984 | Griffin et al. | 261/65 |
| 4,509,720 | 4/1985 | Griffin et al. | 251/308 |

FOREIGN PATENT DOCUMENTS

| | | | |
|---|---|---|---|
| 56-39328 | 4/1981 | Japan | 267/168 |
| 59-46346 | 3/1984 | Japan . | |

*Primary Examiner*—Tim Miles

*Attorney, Agent, or Firm*—C. K. Veenstra

[57] ABSTRACT

A throttle return spring assembly having inner and outer torsion springs contained between end housings is preassembled and then mounted as a unit about a throttle body shaft.

9 Claims, 9 Drawing Figures

THROTTLE RETURN SPRING ASSEMBLY

TECHNICAL FIELD

This invention relates to a throttle return spring assembly suitable for biasing the throttle of an internal combustion engine to its minimum air flow position.

SUMMARY OF THE INVENTION

In conventional internal combustion engines, air flow to the engine is controlled by a throttle mounted on a throttle shaft which is journalled in a throttle body. The throttle is biased to its minimum air flow position by a pair of throttle return springs. The springs are engaged between the throttle body and a throttle lever connected to the throttle shaft and assure that the throttle is returned to its minimum air flow position in the absence of a throttle opening force.

This invention provides a throttle return spring assembly which includes inner and outer torsional throttle return springs captured between spring housings. This throttle return spring assembly may be preassembled and torsionally pre-wound, secured by a clip, and then mounted as a unit on a throttle body shaft. Removal of the clip after the spring assembly is mounted on the throttle body shaft causes the springs to engage between the throttle body and the throttle lever.

This invention accordingly simplifies installation of a throttle return spring assembly on a throttle body shaft.

The details as well as other features and advantages of a preferred embodiment of this invention are set forth in the remainder of the specification and are shown in the accompanying drawings.

THE PREFERRED EMBODIMENT

Referring first to FIGS. 1–4, a throttle body 10 has an induction passage 12 for air flow to the engine. A throttle 14 is disposed in induction passage 12 on a throttle shaft 16 and is rotatable with shaft 16 in the usual manner between a minimum air flow position and a maximum air flow position to control air flow through induction passage 12.

Figure 1:
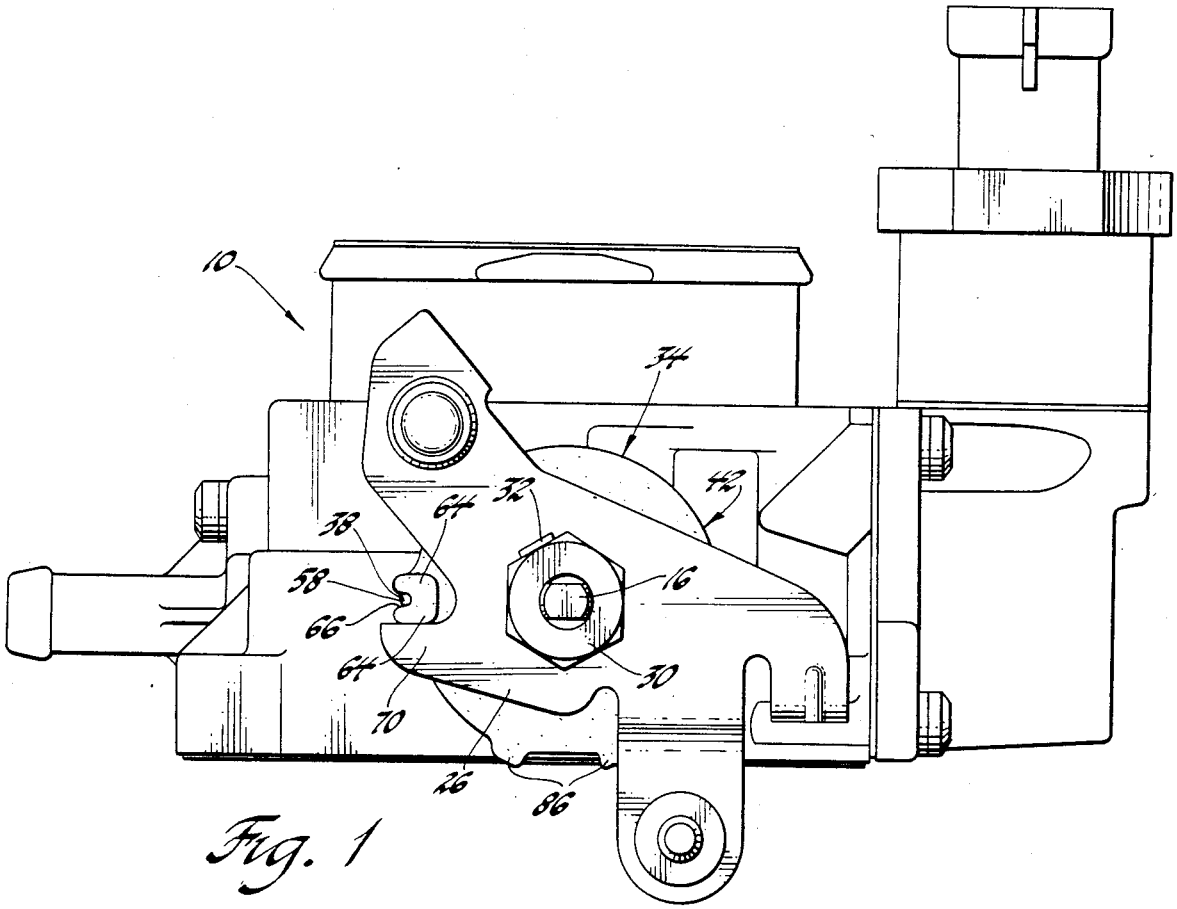
FIG. 1 is a side elevational view of a throttle body equipped with a preferred embodiment of this throttle return spring assembly.

As set forth in application Ser. No. 511,534 filed July 7, 1983 in the names of M. D. Griffin, J. A. Gural and D. J. Lamirande, now U.S. Pat. No. 4,509,720, throttle shaft 16 projects from a boss 18 on throttle body 10. In cross-section, the end of shaft 16 has a double-D configuration, as shown in FIG. 1, and is threaded to receive a nut 20. A pair of shims 22 and 24 is carried on nut 20 to space nut 20 from boss 18. The threaded engagement between nut 20 and shaft 16 allows nut 20 to be positioned on shaft 16 to establish a selected clearance between nut 20 and boss 18. The outer perimeter of nut 20 has a series of external splines which allow automated equipment to adjust the position of nut 20 on shaft 16 during assembly so that the selected clearance is established.

A throttle lever 26 slides onto shaft 16 and has a complementary double-D configuration which secures lever 26 and shaft 16 for concomitant rotation. Lever 26 is thus effective for moving throttle valve 14 between minimum and maximum air flow positions as lever 26 is moved between closed throttle and open throttle positions. A retainer 28 is sandwiched between throttle lever 26 and nut 20 and also has a complementary double-D configuration which secures retainer 28 and shaft 16 for concomitant rotation. Retainer 28 has a series of internal splines which mesh with the external splines on nut 20; retainer 28 thereby secures nut 20 against rotation on shaft 16 which would disturb the selected clearance between nut 20 and boss 18.

Lever 26 is retained on shaft 16 by a nut 30, a lock washer 32 being sandwiched between nut 30 and lever 26.

A throttle return spring assembly 34 is mounted about shaft 16 and is contained between throttle lever 26 and throttle body 10. Spring assembly 34 includes inner and outer torsion springs 36 and 38, each formed as a barrel-shaped helical coil. Springs 36 and 38 are captured by a pair of spring housings 40 and 42. As may be seen in FIG. 4, spring housing 40 fits over boss 18 while spring housing 42 fits over retainer 28. It is contemplated that spring housings 40 and 42 will be formed of a 30–35% glass filled, heat stabilized, nylon 66.

Figure 6:
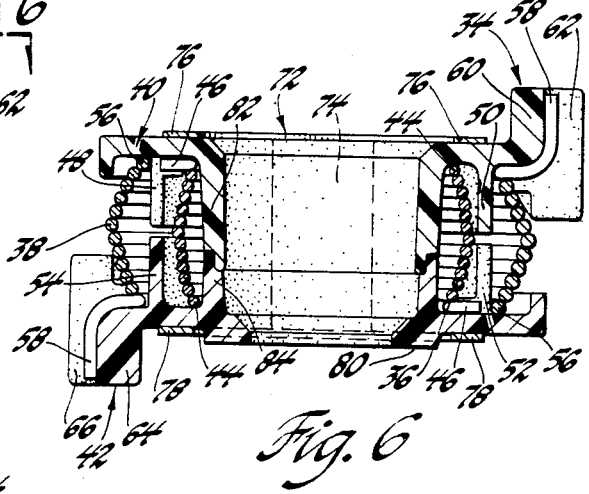
FIG. 6 is a sectional view taken along line 6—6 of FIG. 5 showing further details of the throttle return spring assembly.

As shown in FIG. 6, the opposite end loops 44 of inner spring 36 terminate in end segments 46. At the throttle body side of assembly 34, one of the inner spring end segments 46 extends radially through a notch 48 formed in a cylindrical wall 50 that projects axially from spring housing 40 toward spring housing 42. At the throttle lever end of spring assembly 34, the other inner spring end segment 46 extends radially through a notch 52 in a cylindrical wall 54 that projects axially from spring housing 42 toward spring housing 40.

The opposite end loops 56 of outer spring 38 terminate in end segments 58. On the throttle body side of spring assembly 34, housing 40 has a boss 60 projecting radially from the perimeter of housing 40 and also projecting axially from the perimeter of housing 40 away from housing 42. Boss 60 has a groove or recess 62 formed radially therein and extending axially therethrough; groove 62 receives one of the outer spring end segments 58. Housing 42 has a similar boss 64 also projecting radially from the perimeter of housing 42 and extending axially from the perimeter of housing 42 away from housing 40. A groove or recess 66 extending radially into and axially along boss 64 receives the other end segment 58 of outer spring 38.

Figure 2:
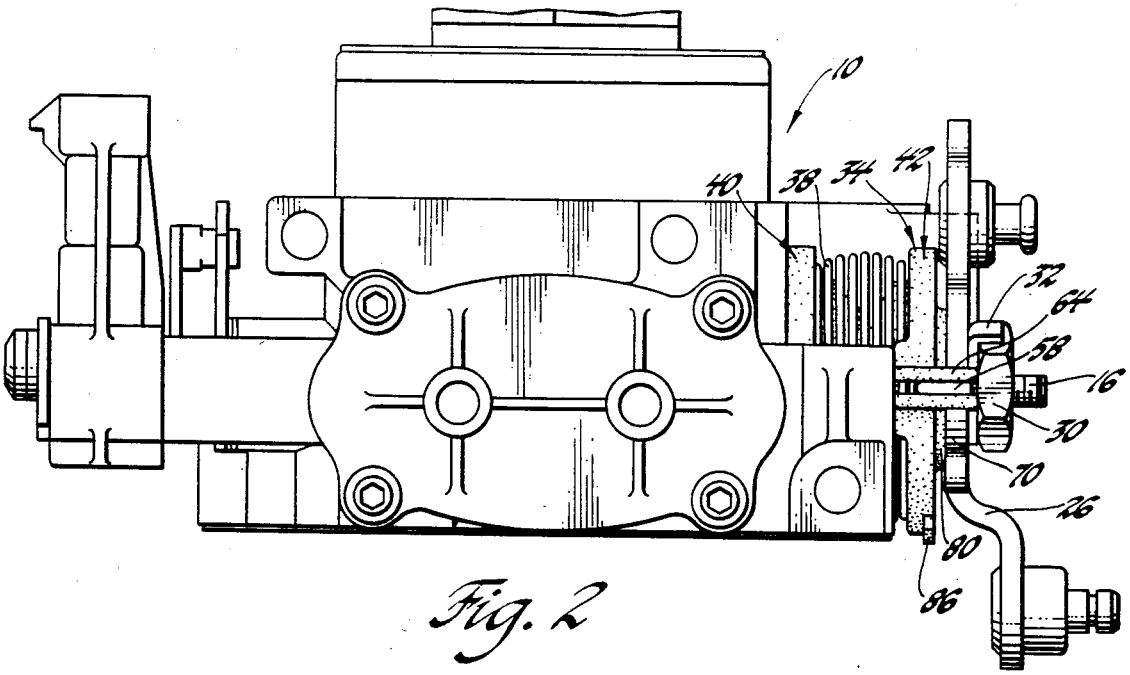
FIG. 2 is a view of the left end of the FIG. 1 throttle body, further showing the throttle return spring assembly.
Figure 3:
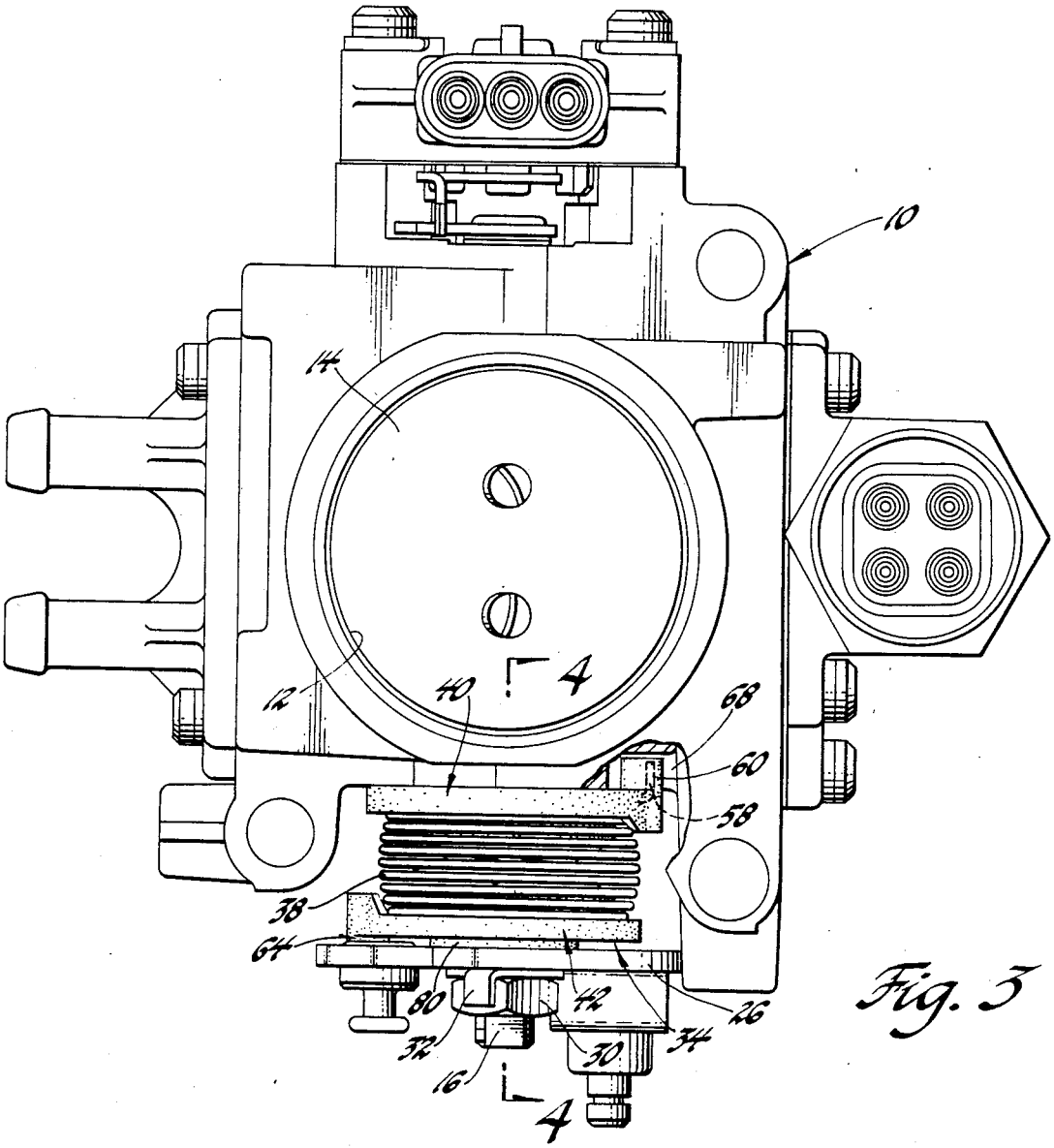
FIG. 3 is a plan view of the FIG. 1 throttle body, further showing the throttle return spring assembly.
Figure 4:
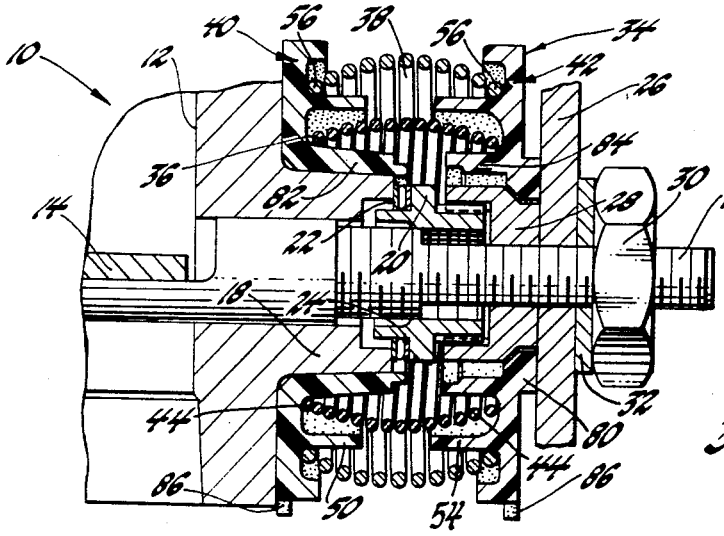
FIG. 4 is a sectional view taken along line 4—4 of FIG. 3, showing additional details of the throttle return spring assembly.

As shown in FIG. 3, boss 60 engages an abutment 68 formed on throttle body 10, while as shown in FIGS. 1 and 2, boss 64 engages an arm 70 of throttle lever 26. The torsion of springs 36 and 38, reacting against the abutment 68, biases throttle lever 26 and throttle shaft 16 counterclockwise to their closed throttle position as shown in FIG. 1 and thereby biases throttle valve 14 to its minimum air flow position.

Figure 5:
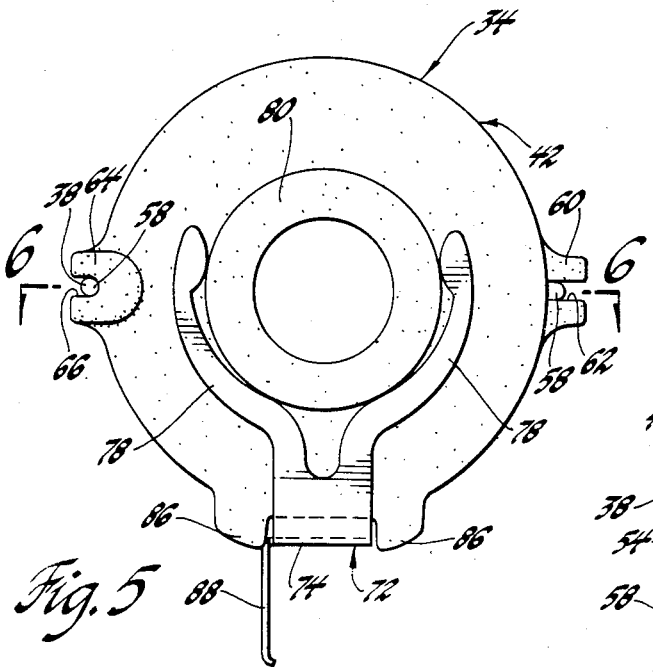
FIG. 5 is a side elevational view, in the same direction as the FIG. 1 view, of the throttle return spring assembly prior to mounting on the throttle body shaft.
Figure 7:
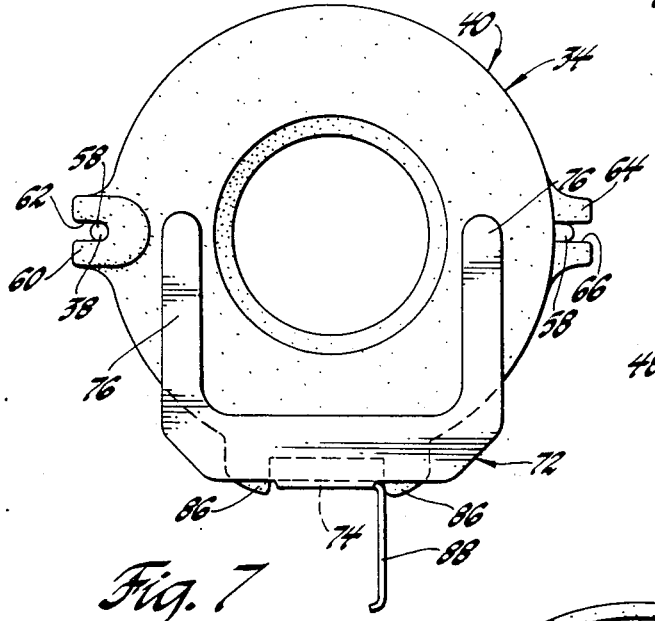
FIG. 7 is an elevational view of the other side of the throttle return spring assembly.
Figure 8:
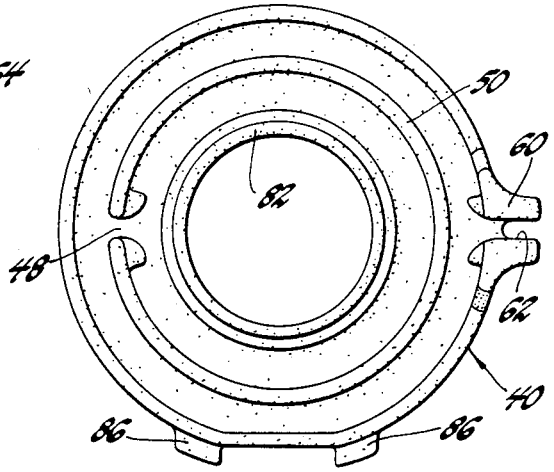
FIG. 8 is a view, taken in the same direction as the FIG. 5 and FIG. 1 views, of the inner surface of one of the throttle return spring housings.
Figure 9:
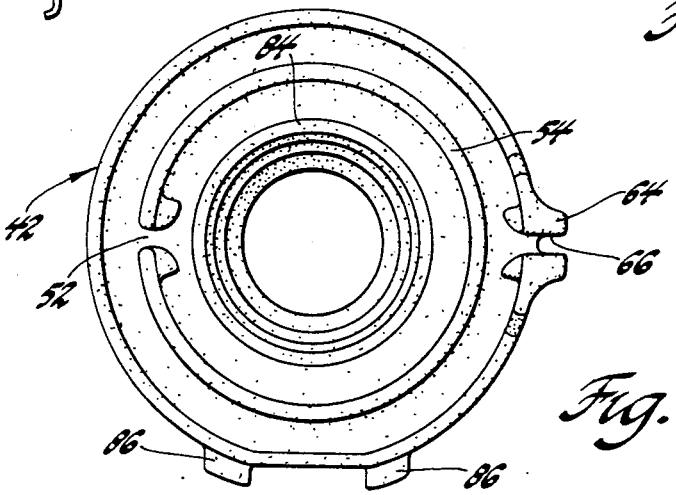
FIG. 9 is a view of the inner surface of the other throttle return spring housing.

As shown in FIGS. 5–7, throttle return spring assembly 34 may be preassembled, housings 40 and 42 rotated relative to one another to torsionally pre-wind springs 36 and 38, and assembly 34 then secured with a clip 72. Clip 72 includes a strut 74 extending axially along the perimeter of spring housings 40 and 42 and has two pairs of transversely extending fingers 76 and 78. Fingers 76 engage the outwardly facing end surface of spring housing 40, while fingers 78 engage the outwardly facing end surface of spring housing 42. As may be seen in FIG. 5, fingers 78 also embrace a boss 80 raised from the end surface of spring housing 42 to secure clip 72 in place.

To secure throttle return spring assembly 34 with clip 72, springs 36 and 38 are collapsed axially to allow an inner cylindrical extension 82 projecting from spring housing 40 to telescope within a cylindrical extension 84 projecting from spring housing 42. Extensions 82 and 84 engage each other both axially and radially when springs 36 and 38 are collapsed to hold housings 40 and 42 in radial alignment. Housings 40 and 42 also have tabs 86 which embrace strut 74 to hold housings 40 and 42 in rotational alignment after the torsional pre-winding.

After throttle return spring assembly 34 has been preassembled, it is mounted about throttle shaft 16 on boss 18, and throttle lever 26 is installed with its lock washer 32 and nut 30. Clip 72 is then removed from return spring assembly 34, a hook portion 88 being provided for that purpose. Springs 36 and 38 thereupon expand axially to engage housing 40 with throttle body 10 and to engage housing 42 with throttle lever 26. Release of strut 74 from tabs 86 as clip 72 is removed also allows rotation of housing 42 with respect to spring housing 40 due to the torsional pre-winding, engaging boss 60 with throttle body abutment 68 and boss 64 with lever arm 70; the reaction from abutment 68 then causes boss 64 to bias throttle lever 26 in a counterclockwise direction to its closed throttle position.

Springs 36 and 38 are barrel-shaped to allow springs 36 and 38 to be collapsed sufficiently to engage extension 82 with extension 84 while clip 72 is installed and to provide the most compact spring assembly. Upon removal of clip 72 and the resultant axial expansion of springs 36 and 38, the coils of each spring are spaced apart and extension 82 is separated from extension 84 to minimize friction.

It will be appreciated that cylindrical walls 50 and 54 maintain inner and outer springs 36 and 38 separated from each other. It also will be appreciated that the symmetry of springs 36 and 38 allows either end of each spring to be captured by either of housings 40 and 42. Further, the housings could be cast of metal rather than molded of plastic and, in some applications, could be identical; the housings also could be formed of sheet metal. Moreover, housings 40 and 42 are designed to accept a pair of springs that will impart a clockwise throttle closure bias in place of springs 36 and 38 which impart a counterclockwise throttle closure bias as described above.

It will be noted that one outer spring end segment 58 overlies throttle body abutment 68 and that the other outer spring end segment 58 overlies throttle lever arm 70. Outer spring 38 accordingly can directly engage abutment 68 and throttle lever arm 70 to bias throttle lever 26 to its closed throttle position even in the absence of spring housings 40 and 42.

In some applications, the throttle return spring assembly is not mounted directly about throttle shaft 16 but instead is mounted about a stub shaft or stud extending from the throttle body adjacent the throttle shaft. Such a throttle body is set forth in U.S. Pat. No. 4,476,068 issued Oct. 9, 1984 in the names of M. D. Griffin and D. J. Lamirande. It should be appreciated that the throttle return spring assembly provided by this invention could be used in that application as well as in the application set forth herein.

The embodiments of the invention in which an exclusive property or privilege is claimed are defined as follows:

1. In a throttle body having an induction passage for air flow, a throttle in said passage for controlling air flow therethrough, a shaft projecting from said body, and a lever mounted on said shaft, said lever being effective for moving said throttle between minimum and maximum air flow positions as said lever is moved between closed throttle and open throttle positions, a throttle return spring assembly mounted about said shaft for biasing said lever to said closed throttle position, said throttle return spring assembly comprising:

an inner torsion spring formed as a helical coil disposed about said shaft, said spring having opposite end loops each terminating in an end segment, an outer torsion spring formed as a helical coil disposed about said inner spring, said outer spring having opposite end loops each terminating in an end segment, and a pair of spring housings disposed about said shaft at opposite ends of said springs, each spring housing having a portion receiving one of said inner spring end segments, each spring housing further having a boss extending from the perimeter of said housing, each boss having a groove receiving one of said outer spring end segments, wherein one of said housing bosses engages an abutment formed on said throttle body and the other of said housing bosses engages said lever for biasing said lever to said closed throttle position, and wherein the outer spring end segment received by said one boss overlies said abutment and the outer spring end segment received by said other boss overlies said lever, whereby said outer spring can directly engage said abutment and said lever for biasing said lever to said closed throttle position in the absence of said spring housings.

2. In a throttle body having an induction passage for air flow, a throttle in said passage for controlling air flow therethrough, a throttle shaft secured to said throttle and projecting from said body, and a throttle lever secured to said shaft, said lever being effective for moving said throttle between minimum and maximum air flow positions as said lever is moved between closed throttle and open throttle positions, a throttle return spring assembly mounted about said shaft for biasing said lever to said closed throttle position, said throttle return spring assembly comprising:

an inner torsion spring formed as a helical coil disposed about said shaft, said spring having opposite end loops each terminating in an end segment, an outer torsion spring formed as a helical coil disposed about said inner spring, said outer spring having opposite end loops each terminating in an end segment, and a pair of spring housings disposed about said shaft at opposite ends of said springs, each spring housing having a portion receiving one of said inner spring end segments, each spring housing further having a boss extending from the perimeter of said housing, each boss having a groove receiving one of said outer spring end segments, wherein one of said housing bosses engages an abutment formed on said throttle body and the other of said housing bosses engages said lever for biasing said lever to said closed throttle position, and wherein the outer spring end segment received by said one boss overlies said abutment and the outer spring end segment received by said other boss overlies said lever, whereby said outer spring can directly engage said abutment and said lever for biasing said lever to said closed throttle position in the absence of said spring housings.

3. A throttle return spring assembly comprising:

an inner torsion spring formed as a helical coil, said spring having opposite end loops each terminating in an end segment, an outer torsion spring formed as a helical coil disposed about said inner spring, said outer spring having opposite end loops each terminating in an end segment, a pair of spring housings disposed at opposite ends of said springs, each spring housing having a portion receiving one of said inner spring end segments, each spring housing further having a boss extending from the perimeter of said housing, each boss having a groove receiving one of said outer spring end segments, and a clip having a strut extending axially along the perimeter of said housings and a pair of transversely extending fingers disposed at each end of said strut, said fingers engaging the outwardly facing end surfaces of said housings to secure said inner and outer springs and said housings in an assembly.

4. A throttle return spring assembly comprising:

an inner torsion spring formed as a helical coil, said spring having opposite end loops each terminating in an end segment, an outer torsion spring formed as a helical coil disposed about said inner spring, said outer spring having opposite end loops each terminating in an end segment, a pair of spring housings disposed at opposite ends of said springs, each spring housing having a portion receiving one of said inner spring end segments, each spring housing further having a boss extending from the perimeter of said housing, each boss having a groove receiving one of said outer spring end segments, and a clip having a strut extending axially along the perimeter of said housings and a pair of transversely extending fingers disposed at each end of said strut, said fingers engaging the outwardly facing end surfaces of said housings to secure said inner and outer springs and said housings in an assembly, and wherein the peripheral surface of each of said housings has a pair of tabs projecting radially and embracing said strut to hold said housings in alignment.

5. A throttle return spring assembly comprising:

an inner torsion spring formed as a helical coil, said spring having opposite end loops each terminating in an end segment, an outer torsion spring formed as a helical coil disposed about said inner spring, said outer spring having opposite end loops each terminating in an end segment, a pair of spring housings disposed at opposite ends of said springs, each spring housing having a portion receiving one of said inner spring end segments, each spring housing further having a boss extending from the perimeter of said housing, each boss having a groove receiving one of said outer spring end segments, and a clip having a strut extending axially along the perimeter of said housings and a pair of transversely extending fingers disposed at each end of said strut, said fingers engaging the outwardly facing end surfaces of said housings to secure said inner and outer springs and said housings in an assembly, and wherein each of said housings has a cylindrical extension projecting toward the other housing, said extensions telescoping one within the other and each of said extensions engaging the other extension radially to hold said housings in alignment.

6. A throttle return spring assembly comprising:

an inner torsion spring formed as a barrel-shaped helical coil, said spring having opposite end loops each terminating in an end segment, an outer torsion spring formed as a barrel-shaped helical coil disposed about said inner spring, said outer spring having opposite end loops each terminating in an end segment, a pair of spring housings disposed at opposite ends of said springs, each spring housing having a portion receiving one of said inner spring end segments, each spring housing further having a boss extending from the perimeter of said housing, each boss having a groove receiving one of said outer spring end segments, and a clip having a strut extending axially along the perimeter of said housings and a pair of transversely extending fingers disposed at each end of said strut, said fingers engaging the outwardly facing end surfaces of said housings to secure said inner and outer springs and said housings in an assembly, and wherein each of said housings has a cylindrical extension projecting toward the other housing and said springs are compressed axially sufficiently to telescope said extensions one within the other, each of said extensions engaging the other extension both axially and radially to hold said housings in alignment.

7. A throttle return spring assembly comprising:

an inner torsion spring formed as a barrel-shaped helical coil, said spring having opposite end loops each terminating in an end segment extending generally radially, an outer torsion spring formed as a barrel-shaped helical coil disposed about said inner spring, said outer spring having opposite end loops each terminating in an end segment extending generally axially, a pair of spring housings disposed at opposite ends of said springs, each spring housing having a projection extending generally axially toward the other housing and engaged by one of said inner spring end segments, each spring housing further having a boss extending from the perimeter of said housing generally axially away from the other housing, each boss having an axially extending groove receiving one of said outer spring end segments, and a clip having a strut extending axially along the perimeter of said housings and a pair of transversely extending fingers disposed a each end of said strut, said fingers engaging the outwardly facing end surfaces of said housings to secure said inner and outer springs and said housings in an assembly, wherein the peripheral surface of each of said housings has a pair of tabs projecting radially and embracing said strut to hold said housings in alignment, and wherein each of said housings has a cylindrical extension projecting toward the other housing and said springs are compressed axially sufficiently to telescope said extensions one within the other, each of said extensions engaging the other extension both axially and radially to further hold said housings in alignment.

8. The method of mounting a throttle return spring assembly on a throttle body having a shaft projecting from said body, said method comprising the steps of:

assembling said throttle return spring assembly by:

disposing an outer torsion spring formed as a helical coil about an inner torsion spring formed as a helical coil, and disposing a pair of spring housings at opposite ends of said springs, each spring housing having a portion receiving an inner spring end segment, each spring housing further having a boss extending from the perimeter of said housing, each boss having a groove receiving an outer spring end segment, securing said assembly with a clip having a strut extending axially along the perimeter of said housings and a pair of transversely extending fingers disposed at each end of said strut, said fingers engaging the outwardly facing end surfaces of said housings, mounting said assembly about said shaft with one of said housing bosses engaging an abutment on said throttle body, mounting a lever on said shaft with the other of said housing bosses engaging said lever, said lever containing said spring assembly between said throttle body and said lever, and removing said clip whereby the axial compression of said springs disengages each of said housing extensions from the other extension and engages said outwardly facing end surfaces of said housings with said throttle body and said lever and whereby the torsion of said springs biases said lever to a closed throttle position.

9. The method of mounting a throttle return spring assembly on a throttle body having a shaft projecting from said body, said method comprising the steps of:

assembling said throttle return spring assembly by:

disposing an outer torsion spring formed as a barrel-shaped helical coil about an inner torsion spring formed as a barrel-shaped helical coil, said inner spring having opposite end loops each terminating in an end segment extending generally radially, said outer spring having opposite end loops each terminating in an end segment extending generally axially, and disposing a pair of spring housings at opposite ends of said springs, each spring housing having a projection extending generally axially toward the other housing and engaged by one of said inner spring end segments, each spring housing further having a boss extending from the perimeter of said housing generally axially away from the other housing, each boss having an axially extending groove receiving one of said outer spring end segments, each spring housing also having a cylindrical extension projecting toward the other housing and a pair of radially projecting tabs, securing said assembly by:

compressing said springs axially sufficiently to telescope said extensions one within the other, each of said extensions engaging the other extension both axially and radially to hold said housings in alignment, and installing a clip having a strut extending axially along the perimeter of said housings and embraced by said tabs to further hold said housings in alignment, said clip also having a pair of transversely extending fingers disposed at each end of said strut, said fingers engaging the outwardly facing end surfaces of said housings to hold said springs in compression, mounting said spring assembly about said shaft with one of said housing bosses engaging an abutment on said throttle body, mounting a lever on said shaft with the other of said housing bosses engaging said lever, said lever containing said spring assembly between said throttle body and said lever, and removing said clip whereby the axial compression of said springs disengages each of said housing extensions from the other extension and engages said outwardly facing end surfaces of said housings with said throttle body and said lever and whereby the torsion of said springs biases said lever to a closed throttle position.

* * * * *